US006411072B1

(12) United States Patent
Feldman

(10) Patent No.: US 6,411,072 B1
(45) Date of Patent: Jun. 25, 2002

(54) PWM POWER SUPPLY WITH CONSTANT RMS OUTPUT VOLTAGE CONTROL

(75) Inventor: Alan S. Feldman, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/836,708

(22) Filed: Apr. 17, 2001

(51) Int. Cl.[7] ..... G05F 5/00
(52) U.S. Cl. ..... 323/299; 323/285; 323/351
(58) Field of Search ..... 323/282, 283, 323/285, 299, 351

(56) References Cited

U.S. PATENT DOCUMENTS 4,230,970 A * 10/1980 Potter et al.
4,237,405 A * 12/1980 Kellis
4,340,807 A * 7/1982 Raskin et al. ..... 323/299
5,859,506 A * 1/1999 Lemke ..... 323/282
5,920,471 A * 7/1999 Rajagopalan et al. ..... 323/288
5,929,619 A * 7/1999 Chin et al. ..... 323/283
5,949,226 A * 9/1999 Tanaka et al. ..... 323/285

* cited by examiner

*Primary Examiner*—Jeffrey Sterrett

(57) ABSTRACT

A control system and method for supplying a constant RMS voltage to a load includes a outer control loop for monitoring a characteristic variable of the system and an inner control loop for maintaining the power delivered to the load as a function of the received input power. A pulse width modulator (PWM) coupled to both control loops delivers pulses representative of an unregulated input voltage duty cycle. The inner control loop compares the duty cycle representation of the input voltage with a duty cycle representation of the pulse and generates a control signal to the PWM accordingly.

27 Claims, 8 Drawing Sheets

PWM POWER SUPPLY WITH CONSTANT RMS OUTPUT VOLTAGE CONTROL

FIELD OF INVENTION

The present invention generally relates to a system and method for supplying a controlled power to a load and, more particularly, for supplying a constant RMS voltage to a load.

BACKGROUND OF THE INVENTION

In electronic displays, a backlight is used to illuminate the display for viewing purposes. Many high performance transmissive liquid crystal display (LCD) systems, such as those used in the aircraft and avionics industry, utilize a light source positioned behind the display to enable viewing. The LCD is often "backlit" using a small fluorescent discharge lamp.

Fluorescent lamps typically exhibit the highest level of efficiency (i.e., optimal luminance) when they are operated at a particular ambient temperature, which can vary depending upon the lamp, display setting, and ambient conditions. For example, Honeywell International Inc. has found that many of the fluorescent lamps used in aircraft display systems exhibit optimal behavior when operated around 55° C. One common technique for attaining and maintaining a desired lamp temperature includes the use of a heating element having an active control system.

FIG. 1 illustrates a pulse-width modulated power supply system 100 delivering power to a heating element 102 (i.e., the load) of a conventional lamp heating system. Power system 100 includes an active control system having a temperature sensor 104, a comparator 106, and a switching regulator 108. Temperature sensor 104 monitors the temperature of the lamp (not shown); comparator 106 compares the temperature reading to a preset desired temperature (i.e., temperature set point); and, in response to the comparison, regulator 108 controls the amount of DC power supplied to the heating element.

Under normal conditions (e.g., non-extreme weather temperatures), the airplane generators supply approximately 28 volts of DC power. However, the voltage can range from about 18 to 32 volts due to, for example, battery operation and tolerance on the generator. In addition, transient voltage spikes, caused in part by various switching functions, can momentarily increase the voltage to around 80 volts. To help protect the system from destructive voltage spikes and to provide regulated voltage to the heating element, a switching regulator (i.e., regulator 108) is often used.

With some certainty, the pulse-width modulated power system of FIG. 1 produces a constant voltage across heating element 102. Switching regulator 108 typically includes a large number of costly electrical components which require high power input and consume valuable printed wiring board (PWB) area. For example, switching regulator 108 generally requires magnetics, such as transformers and inductors, which are heavy, bulky and often generate unwanted electromagnetic interference (EMI). Moreover, increasing the number of components in a system tends to increase the time required to test the system, repair costs, and the probability of system failure.

FIG. 2 illustrates a power supply system 200 which attempts to solve some of the problems of the pulse-width modulated system, namely by reducing the number of components, weight, and cost. "Off-line" power supply system 200 eliminates the switching regulator and provides unregulated power to the load (a heating element 202). Used herein, "off-line" refers to right-off-the-line or direct without conversion of power. A temperature sensor 204 and a comparator 206 operate in much the same manner as previously discussed for system 100. The unregulated power (approximately 28 volts) generated by the aircraft is directly connected to heating element 202 with a switching element 208 coupled to the return of the 28 volt power.

In operation, power supply system 200 provides power to heating element 202 as determined by the temperature of the lamp (not shown). In other words, temperature sensor 204 provides temperature readings to comparator 206, which in turn compares the reading to a preset desired temperature (e.g., 55° C.) and drives switching element 208 accordingly. The system supplies power to the heating element until the desired temperature is reached and then shuts itself off. It should be noted that hysteresis is inherent in this system, as well as system 100, due in part to thermal lags.

At start-up, the heating element used in aircraft display systems may consume a considerable amount of power and/or an undesirable length of time to reach the operating temperature. Often, especially in colder temperatures, several banks of batteries are used to start the airplane's systems. The voltage available from the batteries is generally lower than the airplane generators used under normal weather conditions. Thus, preferably the heating element in the power supply system is be able to heat the lamp in the least amount of time and use the least possible amount of DC power.

Current airline regulations require the aircraft, including its systems, to be ready to fly from a resting or off state in fifteen minutes, regardless of the climate. If, for example, a power system (such as system 200) is designed around 28 volts to provide enough heat to warm the airplane's display in 15 minutes, then when the output voltage drops to 18 volts, the power system is likely not to produce enough power to heat the display in the given time. On the other hand, if the system is designed around 18 volts, then when the output jumps to 32 volts, too much power (heat) is drawn from the aircraft. Most commercial aircraft have multiple display systems each drawing power from the aircraft. Thus, under certain conditions, multiple off-line systems will quickly consume an extreme amount of power and drain the aircraft's generated power. This situation is intolerable, especially when the aircraft is operating under battery conditions.

SUMMARY OF THE INVENTION

The present invention provides a solution to the prior art problems outlined above. According to various aspects of the present invention, a controlled power system supplies a constant RMS voltage to a load and includes a pulse width modulator, a first control loop configured to monitor a characteristic variable, and a second control loop configured to generate a control signal in accordance with a comparison of a duty cycle representation of a drive signal to the load and a duty cycle representation of a received input voltage.

BRIEF DESCRIPTION OF THE DRAWINGS

These and other features, aspects and advantages of the present invention will become better understood with reference to the following description, appending claims, and accompanying drawings where:

DETAILED DESCRIPTION OF EXEMPLARY EMBODIMENTS

The present invention relates to a voltage control system and more particularly to a constant RMS voltage control system for supplying power to a load. The present invention is particularly suited for use in connection with a display system application. e.g., an LCD system. As a result, the exemplary embodiments of the present invention are conveniently described in that context. It should be appreciated, however, that the system and techniques described herein are useful for supplying power in a variety of applications. For example, the present invention may be useful in constant voltage systems, such as, but not limited to, an incandescent lamp system where a constant luminance is maintained and a pump or fan system where a constant rate of flow is maintained. Moreover, the particular implementations shown and described herein are illustrative of various embodiments of the invention including its best mode, and are not intended to limit the scope of the present invention in any way.

For the sake of brevity, conventional techniques for signal processing, data transmission, signaling, and network control, and other functional aspects of the systems (and components of the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in a practical power control system.

Figure 1:
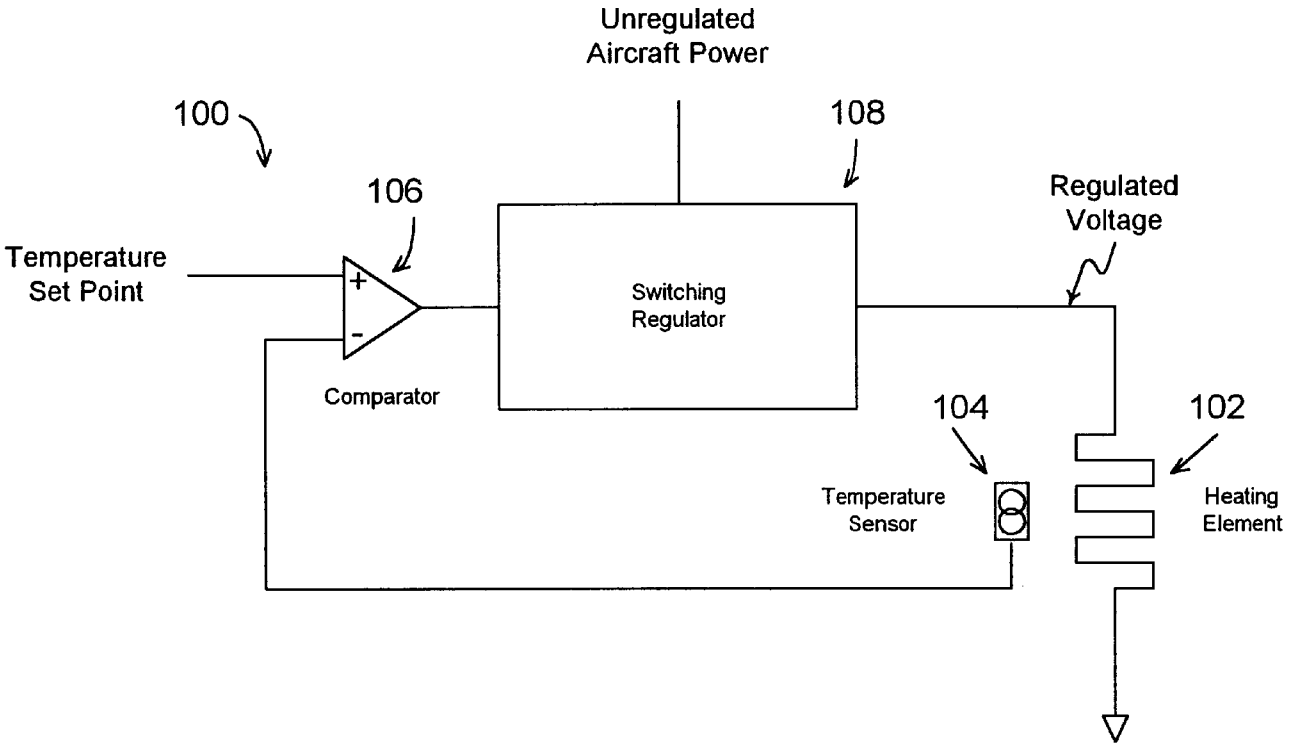
Figure 1 Prior Art
FIGS. 1 and 2 illustrate conventional power supply systems useful in a lamp-heating application.
Figure 2:
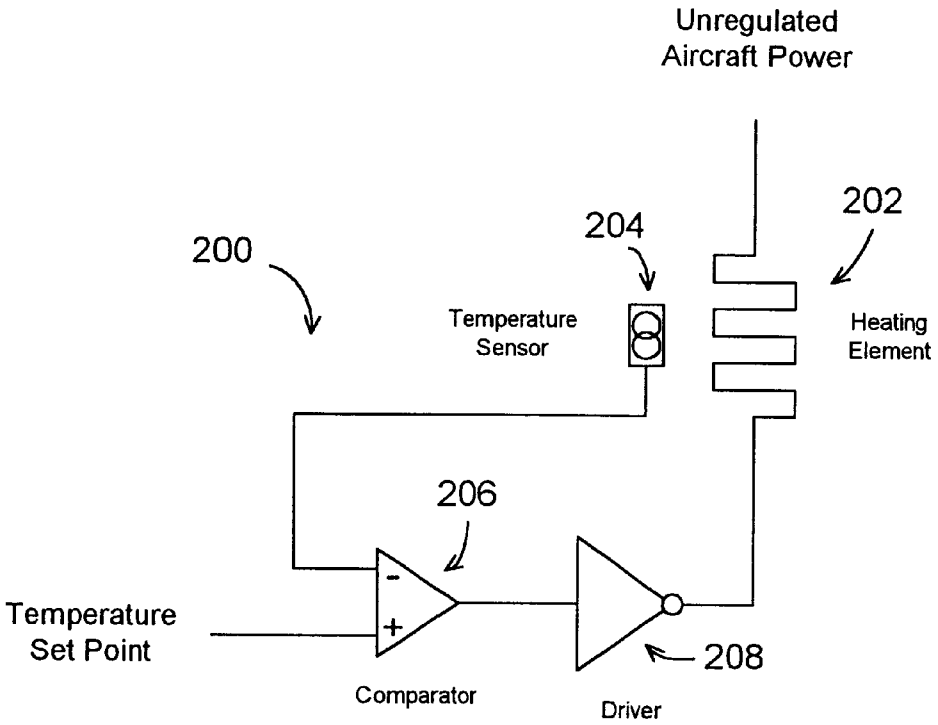
Figure 2 Prior Art
Figure 3:
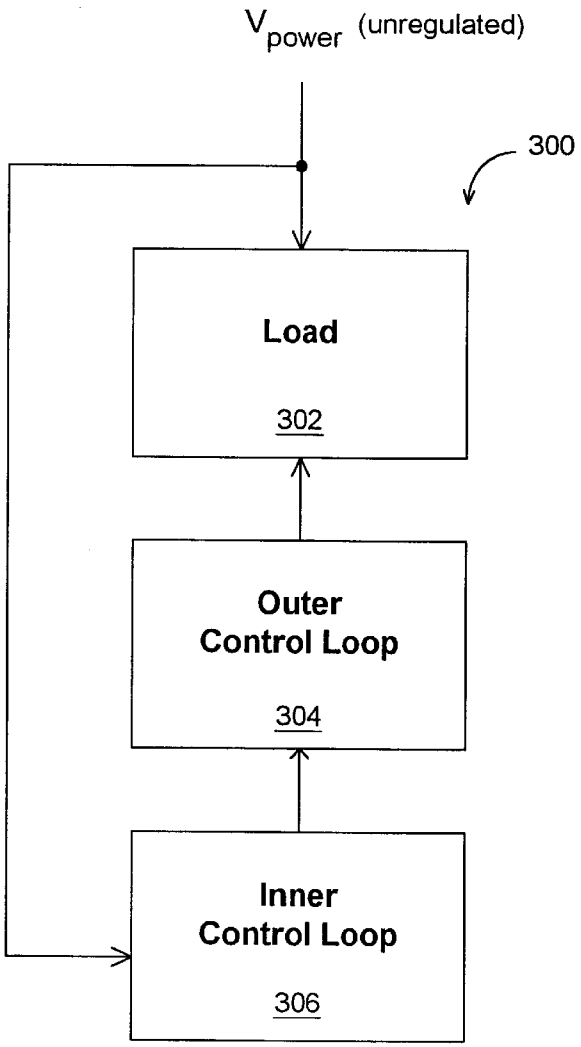
FIG. 3 illustrates, in block format, a power supply system in accordance with the present invention.

FIG. 3 illustrates, in block format, a voltage control system 300 in accordance with the present invention. System 300 includes a load 302, an outer control loop 304, and an inner control loop 306. System 300 is configured to maintain a constant RMS voltage to the load, notwithstanding receiving direct or "off-line" unregulated power from the aircraft. It should be noted that the voltage control system supplies power to the load and therefore, the load is not an actual element of the voltage control system; however, for reference and convenience, the load is included in the following illustrations and accompanying descriptions.

In general, inner control loop 306 maintains the power delivered to the load as a function of the received power voltage, e.g., in an aircraft, the voltage range is from about 18 to 32 volts. Outer control loop 304 monitors a characteristic variable, e.g., the temperature of a lamp in a display system.

As we know, the voltage generated by an aircraft is roughly 28 volts DC, but can vary in range from about 18 to 32 volts. A varying input voltage is likely to cause a varying power output, which is generally unwanted in a constant power supply application. Accordingly, it is advantageous to design a power control system which delivers a constant power, regardless of whether the input voltage is at a low or a high level. For example, if 30 watts of power is the desired output, then the constant power system should deliver around 30 watts at all voltage levels.

Referring to the following Equation 1, it is readily apparent that in an electrical system, both the resistance (R) and the input voltage (V) are proportional to the output power (P).

$$P = \frac{V^2}{R} \tag{1}$$

In other words, if either the resistance or the voltage varies in value, then the power will vary as well. Conversely, if both the resistance and the input voltage are held constant, then the output power will remain substantially constant.

Figure 4:
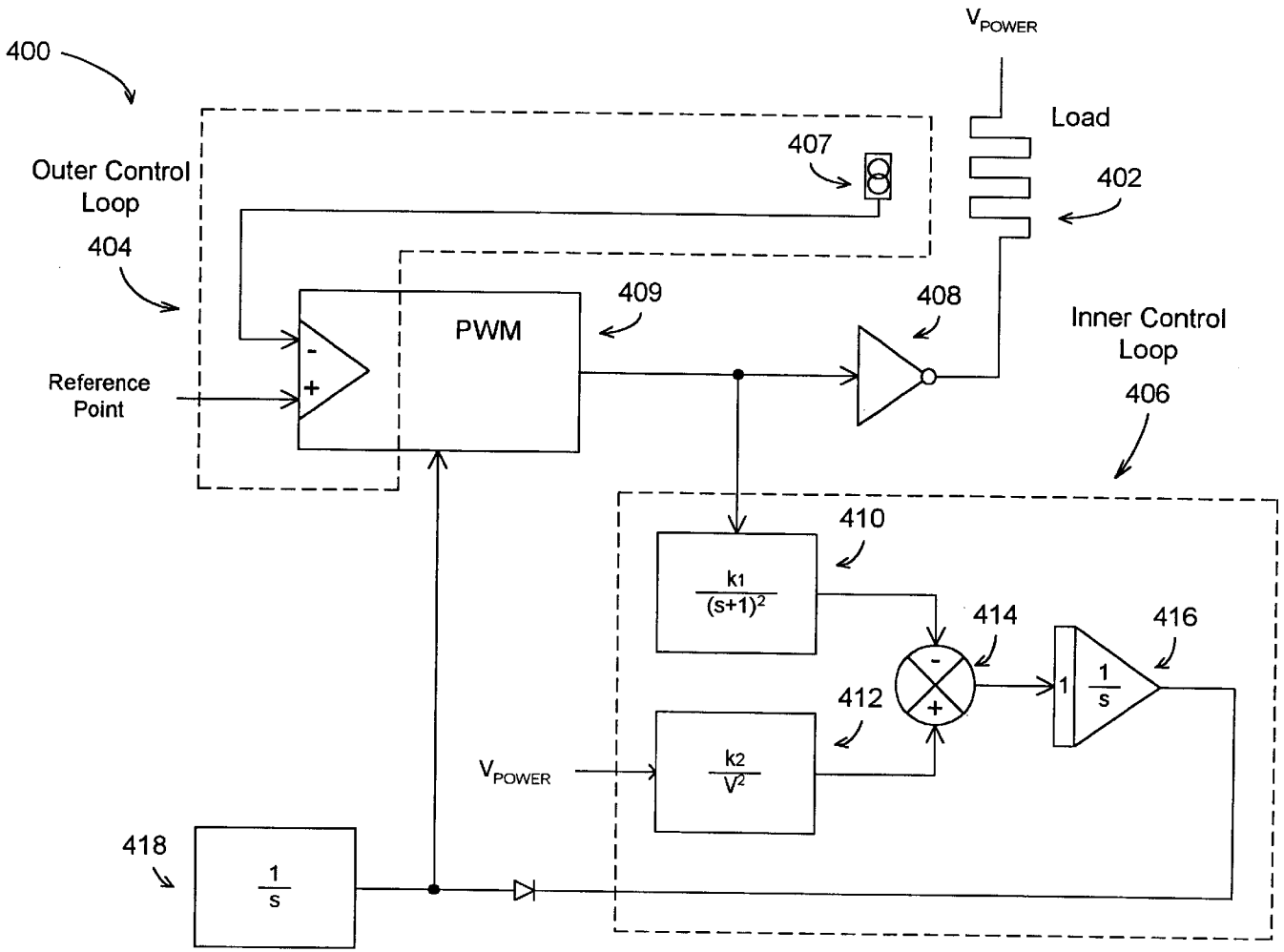
FIG. 4 illustrates a schematic, in block format, of a power supply system in accordance with the present invention.

Referring now to FIG. 4, a block schematic of a voltage control system 400 in accordance with one embodiment and one application of the invention is illustrated. Voltage control system 400, as shown, is suitably configured to control and deliver a constant RMS voltage to a load 402. Similar to system 300, system 400 receives direct or off-line unregulated power from, for example, an aircraft.

System 400 includes an outer control loop 404, an inner control loop 406, and a load 402 (loops 404 and 406 identified in FIG. 4 with dashed outlines). In addition, system 400 may also include a compensation network 418, which will be discussed in detail below. Inner control loop 406 is configured to maintain the power delivered to the load as a function of the received power voltage. Outer control loop 404 is configured to monitor a characteristic variable of the system, e.g., in the present embodiment, loop 404 includes a temperature sensor 407. Each loop and its components will be discussed below; however, it should be appreciated that depending upon the application of the invention, various elements of the system may be combined, eliminated, or altered. For example, in a water flow control application, the load may be a water pump and the temperature sensor may not be needed; and in the case where the load is an incandescent lamp, the temperature sensor may be replaced with a photo sensor.

in the present embodiment, system 400 may be particularly suited for use in a display system having a fluorescent lamp (not shown) in contact with a heating element (i.e., load 402). The temperature of one or more lamps in communication with the heating element is increased as long as the heating element is receiving power. The heating element consists of a coil of wire capable of heat radiation. Conventional wire is made from a material which exhibits an increase in resistance as the temperature increases.

In a controlled power setting, increasing the resistance can be costly to the system both in price and power consumption. For example, as previously discussed go with respect to Equation 1, an increase in resistance can directly decrease the output power. The resistance of the heating element (e.g., load 402) can be held substantially constant, even if the temperature changes, by using temperature invariant wire such as an alloy of copper and tin. Implementation of constant resistance techniques are widely known and beyond the scope of the this invention, thus they will not be discussed in detail.

Referring back to Equation 1, we know that if the resistance and the voltage are held relatively constant, then the output power will remain substantially constant. Maintaining a constant resistance in a system can be done using various known techniques, such as using a temperature invariant wire. Therefore, the systems and techniques for achieving a constant voltage are the focal points of the remaining discussion and the crux of the present invention.

With continued reference to FIG. 4, outer control loop 404 includes a temperature sensor 407 and a comparator section of a pulse width modulator (PMW) 409. As previously mentioned, outer control loop 404 may be configured to monitor a characteristic variable of the system. For example, in the present embodiment, outer control loop 404 is configured to monitor and maintain the temperature of, for example, a fluorescent lamp. Temperature sensor 407 comprises any device, element, system or the equivalent, capable of sensing the temperature, for example, of a fluorescent lamp.

The various systems and methods of the present invention enable delivery of constant power over a range of varying voltage levels. In one embodiment, a constant RMS system and method in accordance with the present invention provides a constant power (e.g., 30 watts) at the lowest level of voltage, (e.g., 18 volts) then as the voltage increases, the PWM in harmony with the inner control loop, maintains the same power (e.g., 30 watts) at all voltage levels. This process is not a linear operation and therefore not trivial; rather, the process is an exponential operation as depicted in the exemplary curve 500 of FIG. 5 and will be discussed in greater detail below.

PWM 409 generates a pulse width modulated signal in response to a comparison between a reference point and an external reading. For example, in the present embodiment, outer loop 404 is configured to monitor the temperature so the reference point may be a desired temperature set point. In this example, the temperature set point may be the optimum operating temperature of a fluorescent lamp for use in an aircraft display, e.g., 55° C. The temperature readings from sensor 407 are received at the comparator section of PWM 409 and compared with the temperature set point. If the temperature reading is lower than the set point, then PWM 409 enables switching element 408 and heating element 402 begins to receive power (this function will be discussed in detail below).

Preferably, PWM 409 is configured to operate at a constant frequency, e.g., 25 kHz, which is well above the audio range of human hearing, yet low enough to minimize loses in switching device 408 and output substantially the same waveform at varying pulse widths. For example, as the input voltage changes, the general shape of output waveform does not substantially change, but the pulse width narrows or widens accordingly.

PWM 409 comprises a control circuit, such as a switching regulator control integrated circuit (IC) or a combination of discrete elements, e.g., operational amplifiers. In one embodiment, an IC such as the SG1524 Pulse width Modulating Regulator, comprises a series of function blocks. For example, a conventional IC for use in system 400 may include components to perform the following non-limited functions (not shown), a ramp generator, an oscillator, an error amplifier, and an output driver. The internal error amplifier (e.g., a discrete element or combination of elements) of the IC compares the analogs of the preset temperature and the output of the temperature sensor. Both signals are presented to the error amplifier as low-level DC voltages. The output of the error amplifier determines whether power, in this case, a voltage switching at the set frequency, is applied to the heating element or not.

A switching device 408 works in conjunction with the load and may comprise various elements commonly known in the industry to cause a "switching effect" or on/off action. Some non-limiting examples of switching device 408 which are suitable for implementation include transistors, e.g. BJT and FET.

Switching device 408 receives pulses from PMW 409. The pulses direct switching device 408 to "open" or "close" the current pathway to the load. In the present embodiment, when switching device 408 closes the pathway, current is allowed to pass through heating element 402, thus causing the heating element to produce heat. Conversely, when switching device 408 opens the pathway, the flow of current to the heating element ceases and heat is no longer produced.

Inner control loop 406 includes a filter 410, a function generator 412, a summer 414, and an integrator 416. As previously mentioned, inner control loop 406 is configured to maintain the power delivered to the load as a function of the received power voltage. Inner control loop 406 controls the duty cycle of PMW 409 (this function will be discussed below).

Filter 410 receives a facsimile of the signal driving switching device 408. The signal is normalized to the maximum level produced by function generator 412 then filtered, thus producing a DC voltage representative of the drive signal's duty cycle. In one embodiment, filter 410 comprises a circuit having a precision voltage limiter 13, followed by a 2-pole lowpass active filter.

Function generator 412 is configured to produce a non-linear reference signal (e.g. waveform 500 of FIG. 5) dependent on the magnitude of the received power ($V_{POWER}$). In other words, function generator 412 monitors the input voltage, e.g., 28 volts DC off-line power, and produces a DC voltage which is a function of the input voltage.

Figure 5:
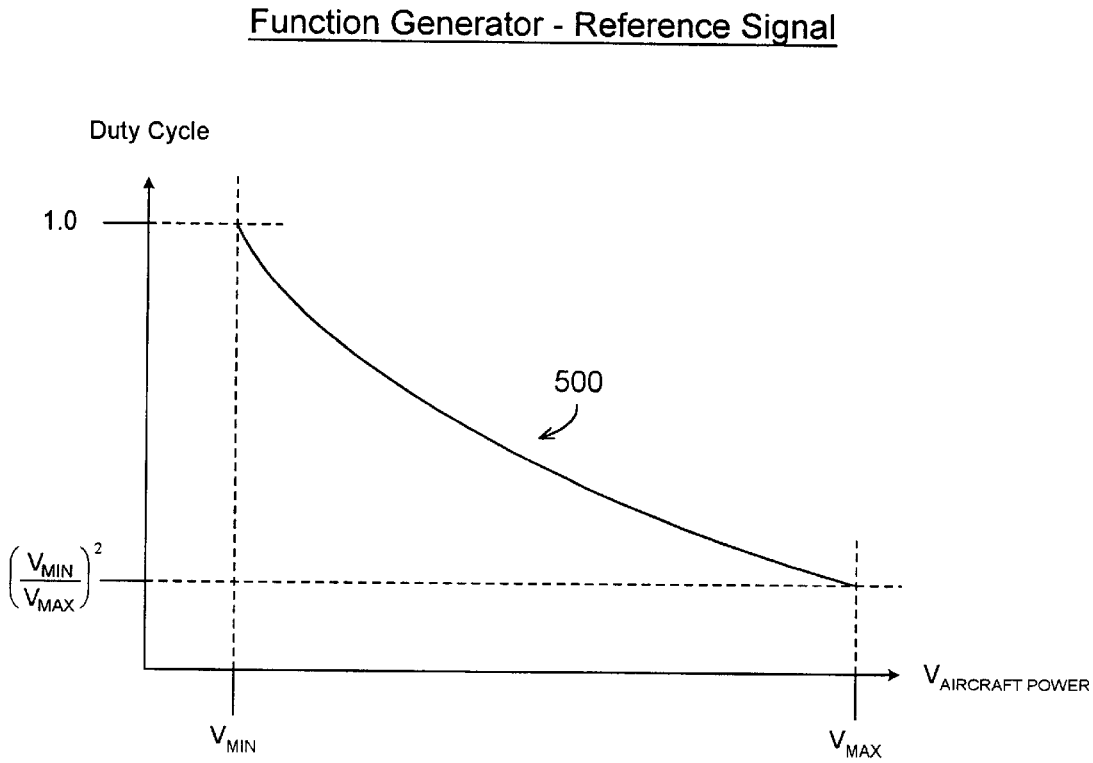
FIGS. 5 and 6 illustrate exemplary waveforms generated by a function generator in accordance with the present invention.

Referring to FIG. 5, an exemplary waveform 500 generated by function generator 412 is illustrated. The abscissa represents the received power (in this embodiment the aircraft power voltage) and the ordinate represents the duty cycle. The maximum duty cycle is 100% or 1.0 on the ordinate and coordinates with the minimum power voltage of the aircraft ($V_{MIN}$). The minimum duty cycle varies along waveform 500 depending upon the input voltage. For example, at a duty cycle of 100%, the minimum voltage may be presumed as 18 volts, and at a minimum duty cycle, the maximum voltage may be presumed as 32 volts. For instance, if the received aircraft power is at a minimum, the function generator will produce a voltage representative of 100% duty cycle ("on" 100% of the time). As the input voltage increases, i.e., more aircraft power is available for use, the function generator corresponds with a voltage representative of a smaller or less percentage duty cycle. Duty cycle is defined as the ratio of "on" time to the total time, or put another way, the time that power is applied versus the total time available. These and other explanations of duty cycle are detailed below. In this embodiment, a voltage range of 18 to 32 volts is a fair representation of the voltage swing demonstrated by an aircraft; however, it should be appreciated that these limits and voltages are merely exemplary and not intended to limit the scope of the invention.

The function generator gain curve (e.g., waveform 500) may be derived in numerous ways. Some suitable examples for generating curve 500 include, but are not limited to, AID and D/A conversion in conjunction with a look-up table memory, analog multipliers, properly configured function generator or square root integrated circuits, and logarithmic amplifiers/chips.

Figure 6:
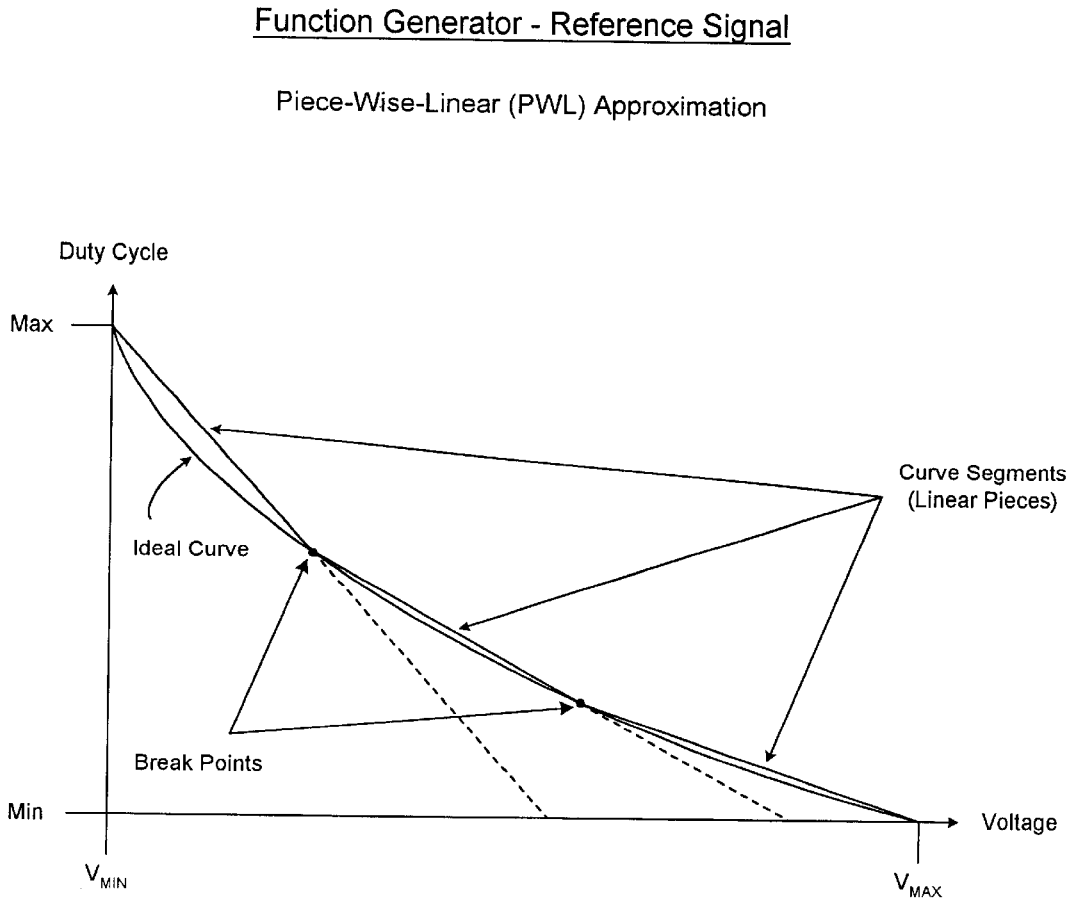

Referring now to FIG. 6, one particular embodiment and implementation of function generator 412 is illustrated. In this embodiment, function generator 412 comprises a number of inexpensive and readily available discrete components, to include operational amplifiers and diodes, configured to produce a piece-wise linear (PWL) approximation. In particular, with the aid of the amplifiers, the diode isolated gains are summed together as a function of the input voltage. In this implementation, three segments or linear pieces accurately approximate the reference signal curve to within about 1%. The mathematical understanding of PWL approximation techniques is widely known and the intricate details of implementation are beyond the scope of this application.

Figure 7:
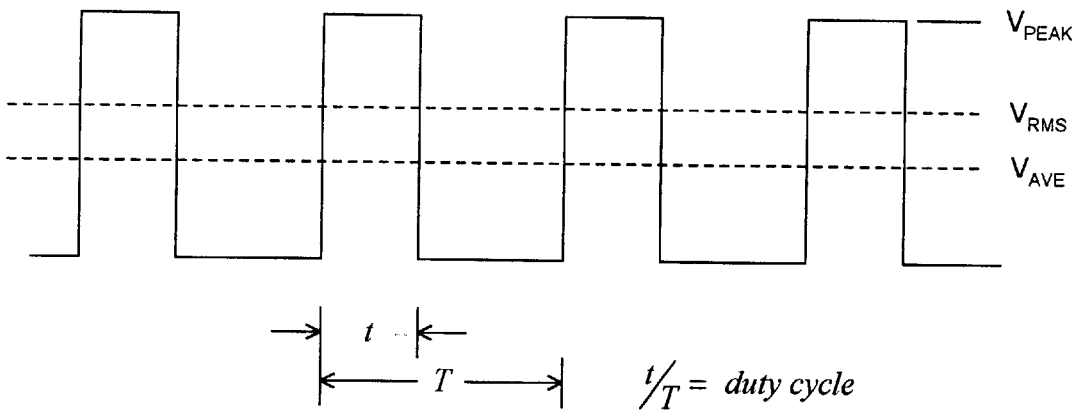
FIG. 7 illustrates an exemplary waveform demonstrating a repetitive voltage.

It is now appropriate to introduce the concepts and correlation between the duty cycle and RMS (root-mean-square) voltage. A constant RMS voltage should not be confused with a constant voltage, even though the two may have an equivalent value and be capable of performing the same amount of work. When a voltage (or current) is applied to a load in a repetitive manner, the effective or RMS value of the voltage is equivalent to a constant DC voltage of the same magnitude. Referring now to FIG. 7, an exemplary waveform demonstrating a repetitive voltage is depicted. The RMS value of the square wave is equal to the peak value of the wave multiplied by the square root of the ratio of the time of power application of one wave cycle to the total time period of the wave. The ratio of the "on" time to the total time is called the "duty cycle," thus the mathematical equation may be written as the following Equation 2:

$$V_{RMS}=V_{MAX}\sqrt{\text{dutycycle}} \text{ or dutycycle}=(V_{RMS}/V_{MAX})^2 \quad (2)$$

where $V_{MAX}$ and $V_{PEAK}$ are equivalent.

Figure 8:
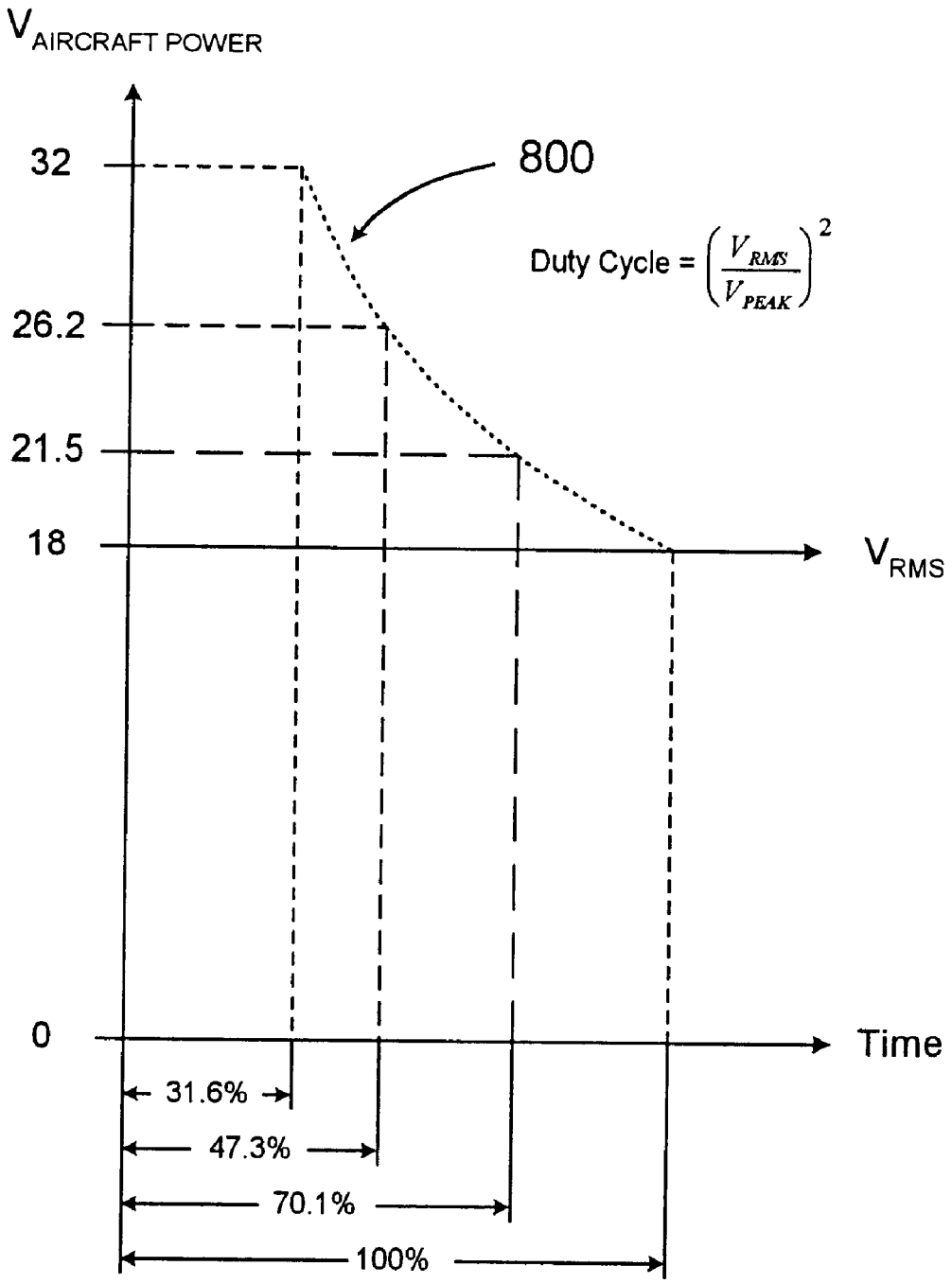
FIG. 8 illustrates an exemplary representation of the duty cycle and voltage varying as a function of input power.

Referring now to FIG. 8, an exemplary graph is illustrated demonstrating how the duty cycle and the voltage amplitude vary as a function of the aircraft power. In this embodiment, the maximum amplitude is 32 volts which corresponds to a 31.6% duty cycle. In other words, at the maximum aircraft power, the ratio of needed on time to total time is 31.6%. As the aircraft voltage decreases, the pulse width widens because the on-time increases. At the maximum duty cycle (100%), the minimum voltage is received at function generator 412 and the pulse is the widest. The resulting duty cycle curve is exponential, as illustrated by dashed line 800.

Referring again to FIG. 4, as previously mentioned filter 410 produces a DC voltage representative of the duty cycle from the signal output of PWM 409 (i.e., curve 800). Function generator 412 produces a DC voltage (i.e., waveform 500) which is a function of the input voltage (i.e., reference signal or $V_{REF}$).

Summer 414 is used to compare the signal output from filter 410 with the signal output from function generator 412. In operation, summer 414 may actually compare the two signals by determining if there is a difference between the two signals. For example, if the signal representing the duty cycle driving switching element 408 is higher than the resulting duty cycle from the input voltage, then the system notifies PWM 409 to narrow the pulse (shorten the on-time). In a similar manner, if the comparison determines that the signal from PWM 409 represents a duty cycle that is too low, then the system will instruct PWM 409 to widen its output in pulse.

The following Example is included to provide a better understanding of the operation of the system and not intended to limit the scope of the invention.

Assuming that an aircraft is generating about 25 volts of power. The off-line power of 25 volts is received at heating element 402 (i.e., load) and function generator 412. Referring to FIG. 8, PWM 409 generates a pulse representing about a 50% duty cycle. In other words, for this example, at 25 volts, the ratio of on-time to total time of the pulse is about 50%. Now, as is common in aircraft systems, suddenly the aircraft voltage drops down to 23 volts because, for example, a second load is receiving power. A voltage of 23 volts is now received at function generator 412 and a different DC voltage that is slightly less than the previous signal will be output. Again referring to FIG. 8, at 23 volts, the duty cycle is slightly more than 50%. The two voltages are compared in summer 414 and this time PWM 409 would be instructed to increase its duty cycle by increasing the pulse widths. This process continues until the two duty cycles represented in the signals from filter 410 and function generator 412 are substantially equal. Thus, as the input voltage changes, the process repeats itself.

Systematically, summer 414 and integrator 416 may be one component or combination of components, but functionally, the two are different. Integrator 416 is provided to avoid "hunting" or changing the value constantly. The two functions may be represented together by an operational amplifier and a capacitor. There are various other combinations of components which will work suitably well in place of summer 414 and integrator 416. For example, a simple summer (no integration) comprising a resistor in place of the capacitor; placement of the capacitor either in series or parallel with the amplifier; and integration with a ramp or exponentially, all are suitable components and techniques for the present system.

In one particular embodiment, summer 414 and integrator 416 comprise at least one discrete error amplifier. The output of the amplifier, acting as negative feedback, is applied to a "compensation" pin of a pulse width modulator IC 409. The output at the pin limits the pulse width of the PWM, thus further assuring a constant RMS voltage is applied to the load, regardless of the magnitude of the aircraft power voltage. In addition, this configuration precludes component temperature and tolerance effects.

With continued reference to FIG. 4, the output of integrator 416 or the equivalent is preferably diode isolated, for example, with respect to the compensation pin of the PWM. Including a diode in the feedback loop to PWM 409 allows the system to limit the maximum pulse width and maintain control of the temperature.

Compensation network 418 provides "shock absorption" for the system in the event of a sudden voltage spike or drop. As previously mentioned, the aircraft voltage typically ranges from 18 to 32 volts; however, spikes as high as around 80 volts or sudden voltage drops are not uncommon.

Compensation network 418 may comprise any suitable component to protect the system from sudden voltage spikes and drops. In one embodiment, compensation network 418 includes a capacitor. The capacitor is connected to a compensation pin of the pulse width modulator IC 409. This connection further assures a "closed loop" operation during power start-up, during application, and removal of power to the load. Compensation network 418, as well as the integration performed by summer 414 and integrator 416, further help to preclude current surges at start-up and circuit engagement.

In another embodiment of the present invention, a small amount of hysteresis is placed in the system. For example, 0.5° C. may be included to prevent the constant turning on and off of the system due to slight temperature fluctuations, thus helping to reduce unwanted stress on the system.

The present invention has been described above with reference to exemplary embodiments. However, those skilled in the art having read this disclosure will recognize that changes and modifications may be made to the embodiments without departing from the scope of the present invention. For example, the minimum and maximum voltages provided herein are merely exemplary and can vary depending on the particular application. In addition, the corresponding duty cycles may be scaled according to particular voltage inputs and desired outputs. Moreover, as previously mentioned, the present embodiment is described in conjunction with aircraft voltage input and an aircraft display system; however, other applications may equally benefit from the methods and systems disclosed herein. For example, in an incandescent lamp system, fan system, or pump system, individual components may be modified as needed, but the spirit of the invention remains. These and other changes or modifications are intended to be included within the scope of the present invention, as expressed in the following claims.

What is claimed is:

1. A control system for supplying a constant RMS voltage to a load, said control system comprising:

a pulse width modulator (PWM) configured to deliver a varying width pulse, said pulse representing a duty cycle of a drive signal to said load;

a first control loop in communication with said PWM, said first control loop configured to monitor a characteristic variable and to generate a control signal to modulate said drive signal to said load, said control signal in response to a comparison of said variable with a predetermined reference point; and a second control loop configured to generate a control signal to said PWM, said control signal of said second control loop in accordance with a comparison of a duty cycle representation of a received input voltage to said system and a duty cycle representation of said drive signal.

2. The control system of claim 1 wherein said received input voltage comprises unregulated power received directly without conversion.

3. The control system of claim 1 wherein said first control loop includes a temperature sensing device and said characteristic variable comprises temperature.

4. The control system of claim 1 wherein said control signal of said second control loop comprises an instruction to vary the width of said pulse delivered by said PWM.

5. The control system of claim 1 wherein said second control loop comprises a filter configured to generate said duty cycle representation of said drive signal.

6. The control system of claim 1 wherein said second control loop comprises a function generator configured to receive said input voltage and to generate said duty cycle representation of said input voltage.

7. The control system of claim 6 wherein said function generator comprises a plurality of discrete components configured to generate a piece-wise linear approximation as a function of said input voltage.

8. The control system of claim 1 further comprising a switching device in communication with said PWM and said load, said switching device configured to receive said pulse from said PWM and in response to said pulse deliver a power to said load.

9. A control system for use in supplying a constant RMS voltage to a load, said control system comprising:

a pulse width modulator (PWM) configured to deliver a varying width pulse, said pulse representing a duty cycle of a drive signal to said load;

a first control circuit comprising a comparator section of said PWM and a temperature sensing mechanism, said comparator section configured to receive a temperature reading from said temperature sensing mechanism and compare said reading with a reference temperature, in response to said comparison, said first control circuit providing a control signal to said PWM; and a second control circuit comprising, a first function circuit configured to receive an input voltage and to generate a duty cycle representation in accordance with said input voltage, a second function circuit configured to receive said drive signal and to generate a duty cycle representation in accordance with said drive signal, and a comparator function circuit configured to receive and compare said duty cycle signal from said first function circuit with said duty cycle representation from said second function signal, and in response to said comparator function circuit comparison, said second control circuit providing a control signal to said PWM.

10. The control system of claim 9 wherein said input voltage comprises unregulated power received directly without conversion.

11. The control system of claim 9 wherein said load comprises a heating element and said temperature sensing mechanism is coupled to a luminescence device.

12. A circuit for controlling the power to a backlighting system of an electronic display, said backlighting system of the type having a lamp coupled to a heating element, said circuit comprising:

a pulse width modulator (PWM) configured to deliver a varying width pulse, said pulse representing a duty cycle of a drive signal to said heating element;

a first control loop in communication with said PWM, said first control loop configured to monitor the temperature of said lamp and to generate a control signal to modulate said drive signal to said heating element, said control signal in response to a comparison of the temperature of said lamp with a predetermined reference point; and a second control loop configured to generate a control signal to said PWM, said control signal of said second control loop in accordance with a comparison of a generated duty cycle representation of a received unregulated input voltage to said system and a generated duty cycle representation of said drive signal.

13. The circuit of claim 12 wherein said second control loop comprises a filter configured to generate said duty cycle representation of said drive signal.

14. The circuit of claim 12 wherein said second control loop comprises a function generator configured to generate said duty cycle representation of said input voltage.

15. The circuit of claim 14 wherein said function generator comprises a plurality of discrete components configured to generate a piece-wise linear approximation as a function of said input voltage.

16. The circuit of claim 12 further comprising a switching device in communication with said PWM and said heating element, said switching device configured to receive said pulse from said PWM and in response to said pulse to deliver power to said heating element.

17. A method for supplying a constant RMS voltage to a load, said method comprising the steps of:

in a first control circuit, monitoring a characteristic variable of a device coupled to said load; and generating a first control signal in response to said monitoring step;

in a second control circuit, receiving an input voltage and said first control signal;

generating a first duty cycle representation of said control signal and a second duty cycle representation of said input voltage;

comparing said first and second duty cycle representations; and generating a second control signal in response to said comparing step;

in a modulating circuit, receiving said first and second control signals; and generating a third control signal in response to said first and second control signals, said third control signal coupled to said load.

18. The method of claim 17 wherein said monitoring step comprises obtaining a reading of said characteristic variable; and comparing said reading with a predetermined reference.

19. The method of claim 17 wherein said characteristic variable comprises temperature, said load comprises a heating element, and said generating a first signal comprises the steps of:

determining whether said temperature of said device is less than a predetermined reference temperature; and generating said first control signal such that said heating element is caused to receive power and increase the temperature of said device if said temperature is less than said reference temperature.

20. The method of claim 17 wherein said receiving an input voltage comprises receiving an unregulated power directly without conversion.

21. The method of claim 17 wherein said modulating circuit comprises a pulse width modulator (PWM) and said third control signal comprises a pulse.

22. The method of claim 21 wherein said first and second control signals indicate an increase or decrease in a width of said pulse.

23. The method of claim 22 wherein an increase in said width of said pulse results in an increase in said first duty cycle representation of said control signal.

24. The method of claim 17 further comprising the step of receiving said third control signal at a switching circuit and in accordance with said third control signal providing a power to said load.

25. A method for controlling the supply of power to a load, said method comprising the steps of:

receiving an input voltage power at a control circuit;

receiving a reference signal at said control circuit, said reference signal representative of a drive signal to said load;

determining a duty cycle representation of said input voltage power and a duty cycle representation of said reference signal;

comparing said duty cycle representation in said control circuit; and generating a control signal at said control circuit in response to said comparing step, said control signal indicating an increase or decrease in said duty cycle representation of said reference signal.

26. The method of claim 25 wherein said control signal configured to maintain a constant RMS voltage to said load.

27. The method of claim 25 wherein determining said duty cycle representation of said input voltage power comprises determining the ratio of an RMS value of said input voltage to a maximum value of said input voltage and squaring said ratio.

* * * * *